United States Patent [19]

Benoit

[11] Patent Number: 4,998,093

[45] Date of Patent: Mar. 5, 1991

[54] PORTABLE PERSONAL ELECTRONIC PERIMETER ALARM

[76] Inventor: John J. Benoit, 39-740 St. Michael Pl., Palm Desert, Calif. 92260

[21] Appl. No.: 285,767

[22] Filed: Dec. 16, 1988

[51] Int. Cl.[5] ..... G08B 13/18; G08G 1/04

[52] U.S. Cl. ..... 340/556; 340/942

[58] Field of Search ..... 340/556, 942, 539; 250/222.1, 561

[56] References Cited

U.S. PATENT DOCUMENTS

| | | | |
|---|---|---|---|
| 2,099,868 | 11/1937 | Sing et al. | 340/942 X |
| 2,212,200 | 8/1940 | Carey | 340/942 X |
| 2,849,701 | 8/1958 | Clark | 340/942 X |
| 3,017,631 | 1/1962 | Fink et al. | 340/825.46 |
| 3,113,270 | 12/1963 | Bassett | 340/825.48 |
| 3,138,357 | 6/1964 | Whitwell et al. | 340/942 X |
| 3,370,285 | 2/1968 | Cruse et al. | 340/556 |
| 3,716,833 | 2/1973 | Roth | 340/942 X |
| 3,896,414 | 7/1975 | Rulo | 340/942 |
| 4,186,388 | 1/1980 | Robinson | 340/556 |
| 4,284,971 | 8/1981 | Lowry et al. | 340/942 X |
| 4,348,652 | 9/1982 | Barnes et al. | 250/561 X |
| 4,613,103 | 9/1986 | Waranowitz | 340/942 X |
| 4,663,624 | 5/1987 | Bui et al. | 340/825.44 |
| 4,808,997 | 2/1989 | Barkley et al. | 340/942 |

*Primary Examiner*—Joseph A. Orsino
*Assistant Examiner*—Thomas J. Mullen, Jr.

[57] ABSTRACT

An extremely reliable, easily portable perimeter alarm system. It is comprised of a light beam controlled radio transmitter and personal warning devices capable of individually warning preoccupied highway workers of the imminent danger present when an errant vehicle violates the established perimeter of a work site. This warning will allow the workers to take evasive action and potentially avoid injury and/or death. It is also the object of this invention to allow for an extremely reliable, easily portable perimeter penetration alarm system that can be utilized in other appropriate settings by security guards, military personnel, etc., and which would provide for confidential notification to such personnel that a temporarily established portable perimeter line had been violated.

3 Claims, 2 Drawing Sheets

PORTABLE PERSONAL ELECTRONIC PERIMETER ALARM

BACKGROUND OF THE INVENTION

1. Field of the Invention.

This invention relates in general to alarm systems, and in particular to a portable arm system utilizing a light beam controlled radio transmitter and remote receivers to personally notify the individual users that a perimeter delineated by the light beam has been penetrated.

2. Description of Prior Art.

One of several potential uses of this invention relates to the safety of highway construction workers. Highway workers are often required by the nature of their work to be exposed to high speed traffic passing by very closely. All too frequently this exposure has resulted in tragedy when a confused, ill or drinking driver enters a construction area and strikes a worker. Often, death or injury could have been avoided had the worker received even momentary notice of the approaching hazard. Unfortunately, the constant sounds of traffic immediately adjacent to the work site makes listening for approaching hazards ineffective. The need for workers to focus their gaze on their work makes watching for approaching hazards impossible.

Heretofore several methods of providing protection to these employees have been utilized with various levels of sub-optimal effectiveness. One such effort involved the designation and assignment of an additional worker to each work site specifically to act as a designated lookout. Unfortunately, the use of a lookout was found to be ineffective for several reasons; (1) at the speed at which traffic is approaching a lookout's own reaction time acts to reduce the system's effectiveness, (2) after recognizing the hazard, there are inherent delays and difficulties in conveying a meaningful and effective warning, and finally, (3) difficulty in maintaining the requisite level of constant attention necessary on the part of the lookout. Therefore, the use of a lookout was abandoned as an ineffective solution to the problem.

Another previous effort aimed at mitigating this hazard involved the placement of an alarm system utilizing a pressure sensitive air hose, of the type previously common in gas stations, around the job site. A high volume siren type alarm was activated near the job site by an electronic device when the air hose was compressed by the weight of a vehicle crossing the line. This method had several critical drawbacks. To be effective, a warning system for this purpose must protect several hundred feet of perimeter. The weight and bulk of this much hose made deployment, occasional repositioning and storing the system very time consuming and physically demanding. But perhaps the most serious drawback associated with this prior art was related to the siren used to warn the workers. A very loud warning siren was placed in such proximity to the workers so as to be heard over the ambient noise of heavy construction equipment and passing traffic. The siren, so amplified, was of such a volume that it frequently startled the worker. This resulted in delayed and occasionally inappropriate reaction to the approaching hazard. Thus, the system itself occasionally created a hazardous condition. As a result of these problems, this approach was also abandoned.

Another commonly utilized method of providing for highway worker protection is to place heavy equipment within the closed roadway segment upstream from the work site. Large pieces of construction equipment are parked crosswise or otherwise blocking the travel lanes some distance from the workers. Unfortunately, this method too has several limitations. Frequently, enough heavy equipment to do the job and protect the work site at the same time is simply not available. Even when available, impacts into the equipment can result in injury to workers nearby. Also, the placement of such equipment is occasionally circumvented by errant drivers who occasionally steer around or otherwise avoid such obstacles. The effectiveness of this method would thus be greatly enhance when utilized in conjunction with this invention. The variety and complexity of these past efforts underscores the serious nature of the problem. Since 1970, 25 highways workers have been killed on the job in California alone. In 1982 the California Department of Transportation initiated a major public relations campaign entitled "Give'em a Brake". This program's primary aim is to emphasis the hazards inherent in this type of work to the motoring public. It's goal is to reduce the number of injuries and deaths of highway workers by asking the public to slow down near highway construction sites. However, injuries and deaths continue to occur. This fact indicates that improved methods to protect highway workers are still very much in demand.

Unfortunately, the problem will very likely get worse, not better. Urban freeways are becoming increasingly more congested. They are also becoming older and more often in need of repair. As traffic congestion becomes increasingly worse in urban areas, many construction projects are now being accomplished at night. Highway workers are at even greater risk during darkness. The lighting of the job site, with sufficient white light to do the work, detracts fom the effectiveness of even lighted traffic control devices. Driver confusion is more likely to occur during darkness. Perhaps even more problematic is the higher percentage of intoxicated drivers that historically plague our highways during these hours.

Each of the individual parts of this invention are commonly known electrical components. Some have been independently utilized for various highway safety and alarm related purposes. However, the individual components incorporated in the present invention have never been combined, offered for sale or utilized in any know application which incorporates a means to provide the type of protection made possible by this invention.

Nevertheless, several devices containing individual elements related to this invention will now be discussed. One such device incorporating a light beam activated detour sign is described in U.S. Pat. No. 3,896,414, Rulo, (1973). This device, entitled Roadway Detour System For Vehicles, utilizes a moveable light beam mounted on poles above the highway in conjunction with warnings signs activated by a light beam/photo cell mechanism. The sole purpose of this system is to sense the presence of over height vehicles and then to selectively activate warning signs and/or sirens to alert the driver of the over height vehicle in advance of the low obstruction ahead. While this device utilizes a light beam to control a detour sign and signaling system in a highway safety related area, it is otherwise totally unrelated to the present invention. The present invention utilizes a portable light beam and photo cell means to control a radio transmitter. An entirely different electronic purpose is therefore accomplished with a totally different highway safety objective.

Another related device is noted in U.S. Pat. No. 3,113,270, Bassett, (1959). This device, entitled Paging Alarm System, combines a small personal transistor radio type receiver, worn by a security guard or agent, with a series of panic or alarm activator buttons located at various points within a fixed protected area. A unique and specific tone is generated by the fixed radio transmitter dependent upon which one of the various panic or alarm activator buttons is utilized. Thus the location of the needed assistance can be recognized by a guard trained to recognize the specific tones. While a remote radio receiver is utilized in this fixed location alarm system, all other aspects of the present invention are distinctly dissimilar and designed to accomplish totally different objectives.

Finally, U.S. Pat. No. 2,099,868, Sing and Waunch (1935), describeds an Automatic Annunciator. This invention utilizes a light beam to detect the presence of an individual to initiate the playing of a phonographically recorded advertizement. Once again, while a light beam detection method is utilized, there is no further similarity with the present invention.

SUMMARY OF THE INVENTION

A main objective of this invention is to provide an extremely reliable, easily portable system that can be utilized to warn workers in advance of an approaching hazard. For highway construction workers and others who work near high speed equipment, time is measured in milli-seconds where safety is concerned. The difference between death and a near miss can often be measured in the number of hundredths's of seconds between the recognition of an approaching hazard and potential impact. This invention will personally signal each worker supplied with a personal warning receiver that an established safety zone has been penetrated.

A typical freeway-highway construction zone deployment of the invention is depicted in FIG. 2. The line of protection would begin 500 to 1,500 feet upstream from the work site and end near the point where traffic passes by the workers. Vehicles crossing into the work site, in violation of the lane closure traffic cones, would thus interrupt the light beam. The amount of advance warning received would be dependant upon where the errant vehicles crosses the light beam. The system would provide approximately 11 seconds warning of a 60 miles per hour vehicle that crosses the light beam 1,000 feet upstream from the work site. The same vehicle entering the safety zone 300 feet from the workers would still result in an advance warning of approximately 3.3 seconds. This advanced warning will dramatically increase the likelihood that a worker will be aware of an approaching hazard in time to react, take evasive action, and perhaps save his/her life.

The highway construction worker is one of many potential beneficiaries of the protection offered by this device. Workers in other environments where high speed equipment is present such as a warehouse, receway, etc., could obviously benefit by the use of this invention. This invention could also be utilized to provide confidential notification of penetration of a designated temporary perimete to guards or military personnel.

BRIEF DESCRIPTION OF THE DRAWINGS

The invention comprises several common electronic components in a new, unique and extremely useful configuration. A typical embodiment of the invention is as shown in the block diagram, FIG. 1. A typical highway deployment is depicted in FIG. 2. The specific individual components of the system depicted in the drawings are:

10*a&b*: a portable battery or generator power source
12: a light beam emitter
14: a light beam
16: optional light beam reflectors
18: a photoelectric light beam detector
20: an electrical amplifier/switch mechanism
22: a low powered radio transmitter
24: one to several personal alarm receivers

DETAILED DESCRIPTION OF THE INVENTION

Figure 1:
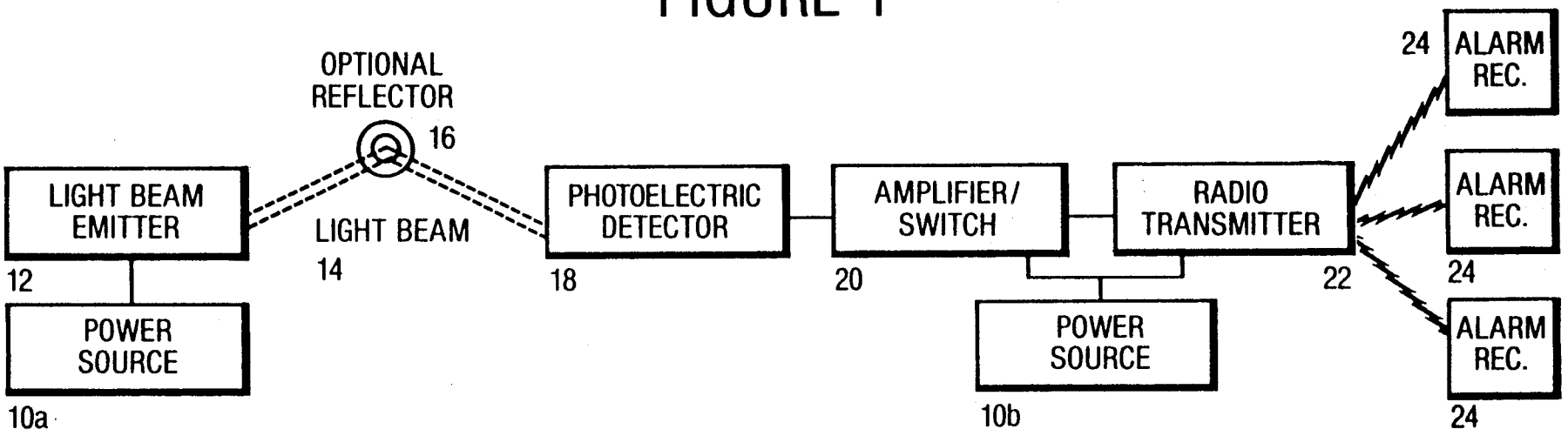
Figure 2:
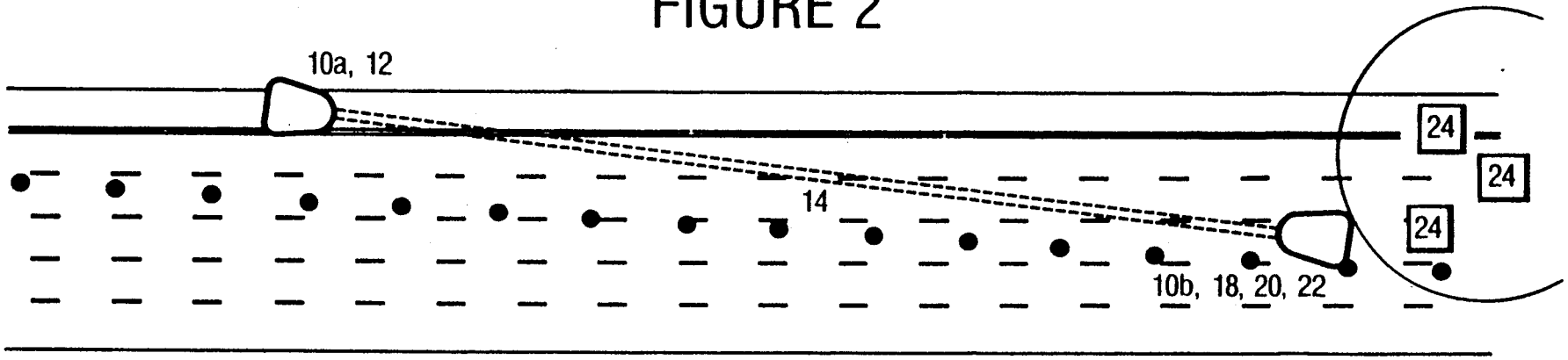

The preferred embodiment of the invention is detailed in FIG. 2 and consists of three primary units. The first is a portable unit containing: a power supply consisting of either a rechargeable battery or a small portable power generator 10*a*; any suitable known light beam generating device capable of producing a suitable focused light beam of sufficient strength, intensity and power utilized as a light beam emitter 12; a focused light beam 14.

The second portable unit contains: a power supply consisting of either a rechargeable battery or a small portable power generator 10*b*; a photoelectric light beam detector 18 which is arranged in any suitable known manner to convert the presence of the light beam to an electrical signal; an amplifier/switch mechanism 20 which is utilized in any suitable known manner to amplify the electrical signal from the photoelectric light beam detector 18 to control the operation of the radio transmitter 22; any suitable known low power radio transmitter 22 capable of generating a continuous low level radio signal.

The third unit in this embodiment consists of the various personal alarm receivers 24. The receivers 24 resemble a common personal pager in appearance, general circuitry and design. Any suitable known existing pager can easily be modified for use in conjunction with this invention. The general mode of operation is simply reversed. Silent operation is maintained by the presence of any suitable known low level radio signal which the warning devices will constantly receive from the radio transmitter 22. The warning devices will emit an alarm whenever the radio signal is interrupted. Each personal alarm receiver 24 would be equipped with an earphone to allow for certain, confidential notification under all ambient noise conditions. Usage of an earphone also allows the warning to be effectively conveyed in a high ambient noise environment without being so loud or intense as to unnecessarily startle the worker and thereby create an additional hazard. Each receiver 24 would also include a low battery warning signal to notify the operator that a battery change was due.

The personal alarm receivers 24 are designed to interpret a momentary interruption of the radio transmitter's 22 signal as a vehicle or pedestrian crossing through the light beam. The receivers 24 would indicate that condition by a series of high pitched tones emitted by a speaker mounted in the receiver 24 or an optional earphone. The receivers 24 would interpret longer interruptions as a system loss or failure which they would announce by a continuous steady tone.

Exceptionally high reliability is an essential component of this invention. The system's method of operation is therefore purposefully designed to be dependant upon the constant positive reception of the radio transmitter's 22 signal. As long as the transmitter's signal is present, the personal alarm receivers 24 remain silent. However, disruption of any of the systems component links which results in a cessation of the radio transmitter's 22 signal would immediately be signaled to all users of the system via their personal alarm receiver 24. There are several potential causes for loss of radio transmitter 22 signal at the personal alarm receivers 24 such as; loss of power at either the light beam generator 10*a* or the radio transmitter 10*b*; the placement of an object in the light path 14; accidental or intentional movement of any system component; failure of the radio transmitter 22 itself; etc. Testing the system's protection can be easily accomplished at any time by momentarily blocking the light beam 14. Longer blockage of the light beam path 14, or failure of any major system component, would generate a steady tone in each personal alarm receiver 24. The user would thus be notified to either restore the system to operation, or, as a minimum, be aware that the protection offered by the invention has been interrupted.

Light beam reflectors 16 could optionally be utilized to create angles in the line of protection. The light beam reflector would incorporate a high quality mirror mounted in a durable, wind resistant stand. One or several of the light beam reflectors could be utilized depending on the configuration of the area to be protected.

A further embodiment of the invention would be to incorporate the light beam emitter 12, photoelectric light beam detector 18, amplifier 20, and radio transmitter 22 into a single physical unit. This embodiment would require the use of at least one light beam reflector 16 to be used to a remote location to bounce the light beam 14 back to the photoelectric light beam detector 18.

Although the description above contains many specificities, these should not be construed as limiting the scope of the invention but as merely providing illustration of some of the presently preferred embodiments of this invention. For example, the protection and advances warning provided by this system may be of significant advantage to security forces attempting to guard a temporary perimeter with limited manpower.

Thus the scope of the invention should be determined by the appended claims and their legal equivalents, rather than by the examples given.

I claim:

1. A portable personal electronic perimeter alarm system comprising:

(a) a light beam emitter powered by a portable power source for emitting light beam, said light beam's presence being constantly sensed by;

(b) a photoelectric light beam detector in combination with an electronic amplifier/switch means used to control;

(c) a radio transmitter powered by a second portable power source and operated by said control means so as to transmit a continuous signal whenever the light beam is being detected at said photoelectric light beam detector;

(d) and a plurality of personal radio alarm receivers for receiving said signal, each having an alarm activated when any interruption of the radio transmitter's signal causes said receivers to stop receiving said signal, whereby all users of the system carrying a said receiver are notified whenever the light beam is broken or any of several critical components of the system fail.

2. A portable personal electronic perimeter alarm system as described in claim 1, further including one or more reflector means for receiving the light beam from the emitter, and for redirecting the light beam to the beam detector.

3. A portable personal electronic perimeter alarm system as described in claim 1, further including one or more reflector means for receiving the light beam from the emitter, and for redirecting the light beam directly back to the light beam detector, thus allowing the light beam emitter and light beam detector/radio transmitter to be located at the same physical location, optionally in a single physical unit, optionally utilizing a single portable power source.

* * * * *